US011851637B2

(12) United States Patent
Armstrong et al.

(10) Patent No.: US 11,851,637 B2
(45) Date of Patent: Dec. 26, 2023

(54) ADHESIVE REMOVER COMPOSITIONS AND METHODS OF USE

(71) Applicants: Ecolab USA Inc., Saint Paul, MN (US); Dow Global Technologies LLC, Midland, MI (US)

(72) Inventors: Carrie Armstrong, Forest Lake, MN (US); Eddie D. Sowle, Woodbury, MN (US); Molly Busby, Midland, MI (US)

(73) Assignees: ECOLAB USA INC., Saint Paul, MN (US); DOW GLOBAL TECHNOLOGIES LLC, Midland, MI (US)

( * ) Notice: Subject to any disclaimer, the term of this patent is extended or adjusted under 35 U.S.C. 154(b) by 563 days.

(21) Appl. No.: 13/974,766

(22) Filed: Aug. 23, 2013

(65) Prior Publication Data

US 2015/0052689 A1 Feb. 26, 2015

(51) Int. Cl.

| | |
|---|---|
| ***C11D 3/20*** | (2006.01) |
| ***C11D 3/43*** | (2006.01) |
| ***C11D 11/00*** | (2006.01) |

(52) U.S. Cl.

CPC ..... *C11D 3/2068* (2013.01); *C11D 3/43* (2013.01); *C11D 11/0017* (2013.01)

(58) Field of Classification Search

CPC ..... C09D 9/04; C11D 17/08; C11D 3/2068; C11D 3/43; C11D 11/0017

See application file for complete search history.

(56) References Cited

U.S. PATENT DOCUMENTS

| | | | | |
|---|---|---|---|---|
| 5,120,371 | A | 6/1992 | Bolden et al. | |
| 5,587,009 | A | 12/1996 | Besse et al. | |
| 5,654,268 | A | 8/1997 | Norcia | |
| 5,849,106 | A | 12/1998 | Bolden et al. | |
| 6,017,863 | A | 1/2000 | Cala et al. | |
| 6,036,727 | A * | 3/2000 | Smith | C11D 3/001 510/277 |
| 6,429,183 | B1 * | 8/2002 | Leonard et al. | |
| 6,838,426 | B1 | 1/2005 | Zeilinger | |
| 7,354,889 | B2 | 4/2008 | Askill | |
| 8,173,146 | B2 | 5/2012 | Leroy | |
| 8,317,879 | B2 | 11/2012 | Sowle et al. | |
| 8,772,215 | B2 * | 7/2014 | Ryther | C11D 3/08 510/218 |
| 9,856,434 | B2 * | 1/2018 | Hunt, Jr. | C11D 3/2041 |
| 2007/0087952 | A1 * | 4/2007 | Hei | C11D 3/2068 510/214 |
| 2007/0191480 | A1 * | 8/2007 | Nelson | C11D 3/2068 514/529 |
| 2007/0275867 | A1 * | 11/2007 | Serobian | C09G 1/16 510/466 |
| 2009/0093390 | A1 * | 4/2009 | Gross | C09D 9/005 510/174 |
| 2010/0267662 | A1 * | 10/2010 | Fielder | A61K 31/196 514/54 |
| 2012/0040880 | A1 * | 2/2012 | Rieth | A61K 8/39 510/138 |
| 2012/0259049 | A1 * | 10/2012 | Donate | C09D 7/20 524/290 |

FOREIGN PATENT DOCUMENTS

| | | | | |
|---|---|---|---|---|
| CN | 100487097 | C | 5/2009 | |
| EP | 1119591 | B1 * | 11/2003 | C11D 3/044 |
| WO | WO1993006204 | A1 * | 4/1993 | |
| WO | WO-9507974 | A1 * | 3/1995 | C11D 7/3227 |
| WO | WO1995007974 | A1 * | 3/1995 | |
| WO | WO 95/21896 | A1 | 8/1995 | |

OTHER PUBLICATIONS

Alcohols and Ethers, 2017.*
Hexyl Carbitol Solvent, MSDS DOW, pp. 1-2, 2013.*
Dowanol EPH glycol Ether, MSDS, DOW, pp. 1-2, 2012.*
Dowanol TPnB, MSDS, DOW, pp. 1-2, 2004.*
Dowanol TPM, MSDS, DOW, pp. 1-2, 2004.*
Dowanol DPM MSDS, DOW, pp. 1-2, 2004.*
Surfactants Product range MSDS https://sasoldcproducts.blob.core.windows.net/documents/Product%20Brochures/SURFACTANTS%20Product%20range.pdf (Year: 2021).*
CN 100487097, Jinhua College Profession & Technology—English Abstract.
3M Material Safety Data Sheet 3M(TM) Gum Remover Ready-to-Use, Apr. 16, 2007, 7 pages.
Carbona Stain Devil #1 Glue, Gum & Nail Polish, ingredient list, Feb. 4, 2011, 1 page.
Carbona Stain Devils Glue, Gum & Nail Polish No. 1, Material Safety Data Sheet, Dec. 4, 2009, 7 pages.

* cited by examiner

*Primary Examiner* — Gregory R Delcotto
*Assistant Examiner* — Preeti Kumar
(74) *Attorney, Agent, or Firm* — McKee, Voorhees & Sease, PLC

(57) ABSTRACT

The invention is directed to adhesive remover compositions and methods of their use. The adhesive remover compositions generally comprise a glycol ether solvent system comprising an aliphatic glycol ether, an aromatic glycol ether, a hydrophobic glycol ether, and a hydrophilic glycol ether, and a surfactant system. In further embodiment of the invention, the surfactant system may comprise three surfactants. In another aspect of the invention, the composition effectively removes medical adhesives from healthcare textiles. In a particular embodiment of the invention, the surfactant system may comprise one or more nonionic surfactants

18 Claims, No Drawings

ADHESIVE REMOVER COMPOSITIONS AND METHODS OF USE

FIELD OF THE INVENTION

The invention relates to cleaning compositions and their methods of use for removing adhesives. In particular, the cleaning compositions may be used to remove medical adhesives from textiles, more particularly from healthcare textiles.

BACKGROUND OF THE INVENTION

Medical adhesives have many uses, including securing wound dressings, surgical drapes, tapes, sensors and the like, as well as skin sealant and liquid sutures, etc. Medical adhesives are particularly difficult to remove from textiles. Healthcare textiles are expensive and existing detergents and solvent approaches largely fail to remove many types of medical adhesives from healthcare textiles. Medical adhesives not removed during an initial wash require a reclaim process and possibly specific treatment. A reclaim process requires additional labor, water, energy, and time. Even following a reclaim process, many healthcare textiles are still soiled by medical adhesives and are subsequently disposed of. Thus, whether disposed of or treated through a reclaim process, there is a substantial expense for cleaning and/or replacing healthcare linens soiled with medical adhesives.

Moreover, existing detergents typically require between about 20-50 ounces of detergent or solvent per 100 pounds of laundry. In a reclaim process even more detergent is required. Another problem with existing cleaning products is that the more effective ones often include phosphorus, nonylphenol ethoxylates (NPEs), linear alkyl ethoxylates (LAEs), petroleum distillates, or D-limonene. These ingredients are undesireable for a number of reasons.

Phosphorus is disfavored due to environmental concerns. Similarly, NPEs are disfavored due to environmental concerns. For example, NPEs are formed through the combination of ethylene oxide with nonylphenol (NP). Both NP and NPEs exhibit estrogen-like properties and may contaminate water, vegetation, and marine life. NPE is also not readily biodegradable and remains in the environment or food chain for indefinite time periods. An alternative to NPEs are LAEs, which are less toxic and degrade more quickly in the environment.

Petroleum distillates (e.g., naphtha, paraffin) are disfavored due to environmental concerns including environmental persistence and bioaccumulation. D-limonene is a recognized skin and respiratory irritant. Thus, it may be particularly disfavored in healthcare settings. There is, therefore, a need for an adhesive remover, particularly effective for removing medical adhesives that does not contain phosphorus, NPEs, LAEs, petroleum distillates, and D-limonene.

Accordingly, it is an objective of the claimed invention to develop an efficacious adhesive remover, particularly for removing medical adhesives.

A further object of the invention is to develop an adhesive remover that is effective at removing medical adhesives from textiles, particularly healthcare textiles.

A further object of the invention is to provide an adhesive remover that requires less volume of the composition per 100 pounds of laundry, to effectively remove adhesive soils.

A further object of the invention is to provide an adhesive remover that is free of phosphorus.

A further object of the invention is to provide an adhesive remover that is free of NPEs.

A further object of the invention is to provide an adhesive remover that is free of LAEs.

A further object of the invention is to provide an adhesive remover that is free of petroleum distillates.

A further object of the invention is to provide an adhesive remover that is free of D-limonene.

A further object of the invention is to provide a composition and method of removing medical adhesives that is more labor, energy, and cost efficient.

BRIEF SUMMARY OF THE INVENTION

An advantage of the invention is a cleaning composition that effectively removes adhesives, particularly medical adhesives. The present invention solves problems in the art by providing a composition that more effectively removes medical adhesives from textiles, particularly healthcare textiles.

Moreover, particular embodiments of the invention can be free of any or all of the following: phosphorous, NPEs, LAEs, petroleum distillates, and D-limonene, which have been required for effective cleaning in existing adhesive remover compositions.

The present invention requires less volume of adhesive remover to effectively remove adhesive soils than existing cleaning compositions and methods.

In light of these advantages, the present invention can be more labor, energy, and cost efficient.

Accordingly, an embodiment of the invention is found in an adhesive remover composition comprised of a glycol ether solvent system comprising an aliphatic glycol ether, an aromatic glycol ether, a hydrophobic glycol ether, and a hydrophilic glycol ether, and a surfactant system. In another aspect of the invention, the composition effectively removes medical adhesives from healthcare textiles. In another aspect of the invention, the glycol ether solvent system comprises between about 8 wt. % and about 94 wt. % and the surfactant system comprises between about 6 wt. % and about 90 wt. %. In a particular embodiment of the invention, the composition may further comprise water between about 0 wt. % and about 30 wt. %. In further embodiment of the invention, the surfactant system may comprise three surfactants. In a particular embodiment of the invention, the surfactant system may comprise one or more nonionic surfactants.

A further embodiment of the invention is found in a method of removing adhesives from textiles comprised of combining an aliphatic glycol ether, an aromatic glycol ether, a hydrophobic glycol ether, and a hydrophilic glycol ether, and a surfactant system to form an adhesive remover, contacting a textile soiled by an adhesive with the adhesive remover, and washing the textile at a temperature between about 100° F. and about 200° F. In another embodiment of the invention, the adhesive remover may further comprise water. In another aspect of the invention, the contacting step may further comprise contacting the textile with about 2 ounces to about 20 ounces of an adhesive remover per about 100 pounds of textiles.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE INVENTION

The present invention relates to compositions for removing adhesives, particularly medical adhesives from healthcare textiles, and methods of using the compositions to remove medical adhesives from textiles. The compositions and methods of use have many advantages over existing adhesive removers. For example, composition effectively removes difficult adhesives, including medical adhesives. Furthermore, the present invention is effective for removing medical adhesives from textiles, particularly healthcare textiles. In particular embodiments, the compositions offer the improvement of being free of any or all of the following: phosphorous, NPEs, LAEs, petroleum distillates, and D-limonene. In particular embodiments, he compositions and methods of use offer the improvement of requiring less volume of adhesive remover to effectively remove adhesive soils. In another aspect, the present invention provides improvements by reducing labor, energy, and costs.

DEFINITIONS

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The recitation of numerical ranges by endpoints includes all numbers subsumed within that range (e.g., 1 to 5 includes 1, 1.5, 2, 2.75, 3, 3.80, 4, and 5).

The embodiments of this invention are not limited to particular compositions and methods of use, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities. Moreover, whether or not values in the specification are modified by the term "about", the term "about" should be understood to apply to those values when desired.

As used in this specification and the appended claims, the singular forms "a," "an," and "the" can include plural referents unless the content clearly indicates otherwise. Thus, for example, reference to a composition containing "a compound" includes a mixture of two or more compounds. As used in this specification and the appended claims, the term "or" is generally employed in its sense including "and/or" unless the content clearly dictates otherwise. Further, all units, prefixes, and symbols may be denoted in its SI accepted form. Numeric ranges recited within the specification are inclusive of the numbers defining the range and include each integer within the defined range.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including hetero aromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

An "anti-redeposition agent" refers to a compound that helps keep suspended in water instead of redepositing onto the object being cleaned. Anti-redeposition agents are useful in the present invention to assist in reducing redepositing of the removed soil onto the surface being cleaned.

As used herein, the term "cleaning" refers to a method used to facilitate or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces.

As used herein, the phrase "health care surface" refers to a surface of an instrument, a device, a cart, a cage, furniture, a structure, a building, or the like that is employed as part of a health care activity. Examples of health care surfaces include surfaces of medical or dental instruments, of medical or dental devices, of electronic apparatus employed for monitoring patient health, and of floors, walls, or fixtures of structures in which health care occurs. Health care surfaces are found in hospital, surgical, infirmity, birthing, mortuary, and clinical diagnosis rooms. These surfaces can be those typified as "hard surfaces" (such as walls, floors, bed-pans, etc.), or fabric surfaces, e.g., knit, woven, and non-woven surfaces (such as surgical garments, draperies, bed linens, bandages, etc.), or patient-care equipment (such as respirators, diagnostic equipment, shunts, body scopes, wheel chairs, beds, etc.), or surgical and diagnostic equipment. Health care surfaces include articles and surfaces employed in animal health care.

As used herein, the term "instrument" refers to the various medical or dental instruments or devices that can benefit from cleaning with a composition according to the present invention. As used herein, the phrases "medical instrument," "dental instrument," "medical device," "dental device," "medical equipment," or "dental equipment" refer to instruments, devices, tools, appliances, apparatus, and equipment used in medicine or dentistry. Such instruments, devices, and equipment can be cold sterilized, soaked or washed and then heat sterilized, or otherwise benefit from cleaning in a composition of the present invention. These various instruments, devices and equipment include, but are not limited to: diagnostic instruments, trays, pans, holders, racks, forceps, scissors, shears, saws (e.g. bone saws and their blades), hemostats, knives, chisels, rongeurs, files, nippers, drills, drill bits, rasps, burrs, spreaders, breakers, elevators, clamps, needle holders, carriers, clips, hooks, gouges, curettes, retractors, straightener, punches, extractors, scoops, keratomes, spatulas, expressors, trocars, dilators, cages, glassware, tubing, catheters, cannulas, plugs, stents, scopes (e.g., endoscopes, stethoscopes, and arthoscopes) and related equipment, and the like, or combinations thereof.

The term "laundry" refers to items or articles that are cleaned in a laundry washing machine. In general, laundry refers to any item or article made from or including textile materials, woven fabrics, non-woven fabrics, and knitted fabrics. The invention additionally provides a composition and method may be used for removing adhesives from non-laundry articles and surfaces including hard surfaces such as dishes, glasses, medical instruments, and other ware.

As used herein, the phrase "laundry application" refers to any method of cleaning laundry, in a laundry washing machine. It is intended to encompass both consumer and commercial methods of cleaning laundry in a washing machine. It is not to be limited to any particular type of washing machine, but is broadly intended to incorporate all types of washing machines, including, for example, washer extractor machines and continuous batch washing (CBW) machines. The term is intended to encompass "regular wash," i.e., a traditional washing cycle, likely, but not necessarily incorporating a detergent, and "reclaim process," i.e., a subsequent wash cycle intended to remove residual soils, often, but not necessarily, used with higher concentrations of adhesive remover, detergent, alkalinity sources, solvents, surfactants, temperatures, etc.

As used herein, the phrases "LAE-free," "substantially LAE-free," or any variations of the same, refer to a composition, mixture, or ingredient that does not contain any LAEs or a LAE-containing compound has not been added. Should LAE or a LAE-containing compound be present through contamination of a LAE-free composition, mixture, or ingredient, the amount of LAE shall be less than 0.5 wt %. More preferably, the amount of LAE is less than 0.1 wt-%, and most preferably the amount of LAE is less than 0.01 wt %.

As used herein, the phrasess "limonene-free," "D-limonene," "substantially D-limonene-free," "substantially limonene-free," or any variations of the same, refer to a composition, mixture, or ingredient that does not contain any limonene or a limonene-containing compound has not been added. Should limonene or a limonene-containing compound be present through contamination of a limonene-free composition, mixture, or ingredient, the amount of limonene shall be less than 0.5 wt %. More preferably, the amount of limonene is less than 0.1 wt-%, and most preferably the amount of limonene is less than 0.01 wt %.

As used herein, the phrase "medical adhesive" refers to any adhesive substance used to secure wound dressings, surgical drapes, bandages, sensors, such as EKG leads, and the like, including, bandages, tapes, skin sealant, and liquid sutures. They are often ethoxy-based or polyacrylic-based.

As used herein, the phrases "NPE-free," "substantially NPE-free," or any variations of the same, refer to a composition, mixture, or ingredient that does not contain any NPEs or a NPE-containing compound has not been added. Should NPEs or a NPE-containing compound be present through contamination of a NPE-free composition, mixture, or ingredient, the amount of NPEs shall be less than 0.5 wt %. More preferably, the amount of NPEs is less than 0.1 wt-%, and most preferably the amount of NPEs is less than 0.01 wt-%.

As used herein, the phrases "petroleum distillate-free," "substantially petroleum distillate-free," or any variations of the same, refer to a composition, mixture, or ingredient that does not contain any petroleum distillates or a petroleum distillate-containing compound has not been added. Should a petroleum distillate or a petroleum distillate-containing compound be present through contamination of a petroleum distillate-free composition, mixture, or ingredient, the amount of petroleum distillates shall be less than 0.5 wt %. More preferably, the amount of petroleum distillate is less than 0.1 wt-%, and most preferably the amount of petroleum distillates is less than 0.01 wt %.

As used herein, the terms "phosphorus-free" or "substantially phosphorus-free" refer to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt %. More preferably, the amount of phosphorus is less than 0.1 wt-%, and most preferably the amount of phosphorus is less than 0.01 wt %.

As used herein, the term "soil" refers to a non-polar oily substance which may or may not contain particulate matter such as mineral clays, sand, natural mineral matter, carbon black, graphite, kaolin, environmental dust, ethoxy-based materials, polyacrylic-based materials, residues left from medical adhesives, etc.

As used herein the term "solid" refers to any solid form of a composition, including, but not limited to the following examples, pellet, block, tablet, powder, granule, flake, particulate, molded, cast, extruded, etc.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "textile" refers to materials that can include natural or synthetic fibers such as silk fibers, linen fibers, cotton fibers, polyester fibers, polyamide fibers such as nylon, acrylic fibers, acetate fibers, and blends thereof including cotton and polyester blends, and the like. The fibers can be treated or untreated. Exemplary treated fibers include those treated for flame retardancy. It should be understood that the term "healthcare textile" is intended to encompass various types of textiles items often used in healthcare/medical applications, including, for example, bed sheets, pillow cases, towels, table linens, table cloths, mops, uniforms, gowns, surgical scrubs, etc.

The term "threshold agent" refers to a compound that inhibits crystallization of water hardness ions from solution, but that need not form a specific complex with the water hardness ion. Threshold agents include but are not limited to a polyacrylate, a polymethacrylate, an olefin/maleic copolymer, and the like.

As used herein the phrase, "use solution," and obvious variants of the same, refer to a solution that contacts a textile, article, or surface to provide the desired cleaning, rinsing, or the like, in a laundry application. In a particular embodiment of the invention, the use solution may contain the adhesive remover composition diluted to the desired concentration. In a further embodiment, the use solution may contain the adhesive remover composition in concentrate. In another aspect of the invention, the use solution may include a detergent, alkalinity source, or optional functional ingredient. The use solution that contacts the textiles to be cleaned in a laundry application can be referred to as a concentrate or a use composition (or use solution) dependent upon the formulation and methods employed according to the invention. It should be understood that the concentration of the solvent system, surfactant system, water and other optional ingredients in the detergent composition will vary depending on whether the detergent composition is provided as a concentrate or is diluted in the use solution.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," "wt %," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

Adhesive Remover Compositions

Surprisingly it was found that an adhesive remover comprised of a combination of multiple solvents in a solvent system and a surfactant system is highly effective at removing typically difficult adhesive soils. Such a system is particularly effective at removing medical adhesives. Moreover, such an adhesive remover is suitable for use with textiles.

In an aspect, the compositions include from about 8 wt-% to about 94 wt-% of a solvent system, from about 6 wt-% to about 60 wt-% of a surfactant system, and optionally from about 0 wt-% to about 20 wt-% water. In addition, without being limited according to the invention, all ranges recited are inclusive of the numbers defining the range and include each integer within the defined range. In a further aspect, the compositions may be substantially free of NPEs, LAEs, petroleum distillates, or D-limonene.

Solvent System

The compositions and methods of this invention utilize a solvent system comprised of at least two solvents, preferably three, more preferably four. Solvents are often useful in cleaning compositions to enhance soil removal properties. Suitable solvents useful in removing hydrophobic soils include, but are not limited to: oxygenated solvents such as lower alkanols, lower alkyl ethers, glycols, aryl glycol ethers and lower alkyl glycol ethers. Examples of other solvents include, but are not limited to: methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether.

Suitable solvents useful in the compositions and methods herein include glycol ether solvents. Glycol ethers are alkyl ethers of ethylene glycol. Glycol ethers can be aliphatic, aromatic, hydrophobic, or hydrophilic. In an aspect of the invention an aliphatic glycol ether solvent may be suitable. In another aspect of the invention an aromatic glycol ether solvent may be suitable. In a further aspect of the invention a hydrophilic glycol ether solvent may be suitable. In a still further aspect of the invention a hydrophobic glycol ether solvent may be suitable. In a particular embodiment of the invention, the adhesive remover composition may contain at least one aliphatic glycol ether, one aromatic glycol ether, one hydrophobic glycol ether, and one hydrophilic glycol ether.

Suitable glycol ethers include, but are not limited to, diethylene glycol n-butyl ether, diethylene glycol n-propyl ether, diethylene glycol ethyl ether, diethylene glycol methyl ether, diethylene glycol t-butyl ether, dipropylene glycol n-butyl ether, dipropylene glycol methyl ether, dipropylene glycol ethyl ether, dipropylene glycol propyl ether, dipropylene glycol tert-butyl ether, ethylene glycol butyl ether, ethylene glycol propyl ether, ethylene glycol ethyl ether, ethylene glycol methyl ether, ethylene glycol methyl ether acetate, propylene glycol n-butyl ether, propylene glycol ethyl ether, propylene glycol methyl ether, propylene glycol n-propyl ether, tripropylene glycol methyl ether and tripropylene glycol n-butyl ether, ethylene glycol phenyl ether, propylene glycol phenyl ether, and the like, or mixtures thereof. Suitable commercially available glycol ethers (all of which are available from the Dow Chemical Company) include Butoxyethyl PROPASOL™, Butyl CARBITOL™ acetate, Butyl CARBITOL™, Butyl CELLOSOLVE™ acetate, Butyl CELLOSOLVE™, Butyl DIPROPASOL™, Butyl PROPASOL™, CARBITOL™ PM-600, CARBITOL™ Low Gravity, CELLOSOLVE™ acetate, CELLOSOLVE™, DOWANOL EPH™, DOWANOL PPH™, DOWANOL TPnB™, Ester EEP™, FILMER IBT™, Hexyl CARBITOL™, Hexyl CELLOSOLVE™, Methyl CARBITOL™, Methyl CELLOSOLVE™ acetate, Methyl CELLOSOLVE™, Methyl DIPROPASOL™, Methyl PROPASOL™ acetate, Methyl PROPASOL™, Propyl CARBITOL™, Propyl CELLOSOLVE™, Propyl DIPROPASOL™ and Propyl PROPASOL™.

In an embodiment, the compositions include from about 8 wt-% to about 94 wt-% of a solvent system. In another embodiment, the compositions include from about 25 wt-% to about 75 wt-% of a solvent system. In a further embodiment, the compositions include from about 36 wt-% to about 61 wt-% of a solvent system.

In an aspect of the invention, the compositions may include an aliphatic glycol ether from about 5 wt-% to about 35 wt-%, preferably from about 10 wt-% to about 30 wt-%, more preferably from about 15 wt-% to about 25 wt-%. In another aspect of the invention, the compositions may include an aromatic glycol ether from about 1 wt-% to about 20 wt-%, preferably from about 5 wt-% to about 15 wt-%, more preferably from about 7 wt-% to about 12 wt-%. In another aspect of the invention, the compositions may include a hydrophobic glycol ether from about 1 wt-% to about 20 wt-%, preferably from about 5 wt-% to about 15 wt-%, more preferably from about 7 wt-% to about 12 wt-%. In another aspect of the invention, the compositions may include a hydrophilic glycol ether from about 1 wt-% to about 20 wt-%, preferably from about 5 wt-% to about 15 wt-%, more preferably from about 7 wt-% to about 12 wt-%.

Surfactant System

The compositions and methods of this invention utilize a surfactant system. The surfactant system may be comprised of one or more surfactants. Surfactants suitable for compositions depend on the solvents employed in the solvent system, the additional functional ingredients that may be incorporated into the compositions, and how the adhesive remover will be used. For example, in a laundry application, it is usually preferable to employ low foaming surfactants; however, moderately to high foaming surfactants may be employed with a defoamer. If the adhesive remover is applied as a prewash or postwash spray, it may be beneficial to employ a moderate to high foaming surfactant. Those of skill in the art will be able to select an appropriate surfactant system.

In a particular embodiment of the invention, the surfactant system may be comprised of at least one surfactant, preferably two surfactants, more preferably three surfactants. Suitable surfactants include, but are not limited to: nonionic, anionic, cationic, and amphoteric surfactants.

In an embodiment, the compositions include from about 6 wt-% to about 90 wt-% of a surfactant system. In another embodiment, the compositions include from about 15 wt-% to about 75 wt-% of a surfactant system. In a further embodiment, the compositions include from about 30 wt-% to about 60 wt-% of a surfactant system.

In an aspect of the invention, the surfactant system may include between two and three nonionic surfactants, each from about 2 wt-% to about 30 wt-%, preferably from about 5 wt-% to about 25 wt-%, more preferably from about 10 wt-% to about 20 wt-%.

Nonionic Surfactants

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp. Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Tetronic® compounds are tetra-flinctional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol™ manufactured by Shell Chemical Co. and Alfonic™ manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol™ manufactured by Henkel Corporation and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

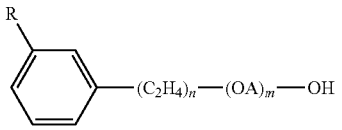

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. (which is incorporated herein by reference in its entirety) having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. (which is incorporated herein by reference in its entirety) having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. (which is incorporated herein by reference in its entirety) corresponding to the formula $Y(C_3H_6O).(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. (which is incorporated herein by reference in its entirety) having the formula $Y[(C_3H_6O_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986, which is incorporated herein by reference in its entirety. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or —$(C_2H_4O)_xH$, where x is in the range of from 1 to 3.

13. A useful class of non-ionic surfactants include the class defined as alkoxylated amines or, most particularly, alcohol alkoxylated/aminated/alkoxylated surfactants. These non-ionic surfactants may be at least in part represented by the general formulae: $R^{20}$—$(PO)_sN$-$(EO)_tH$, $R^{20}$—$(PO)_sN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch). Each of these references are incorporated in their entirety.

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 (R-$(EO)_5(PO)_4$) and Dehypon LS-36 (R-$(EO)_3(PO)_6$); and capped alcohol alkoxylates, such as Plurafac LF221 and Tegoten EC11; mixtures thereof, or the like.

In an embodiment of the invention the adhesive remover compositions may include any of the following commercially available nonionic surfactants: Hexyl Carbitol™ Solvent, DOWANOL™ EPh Glycol Ether, DOWANOL™ TPnB, and DOWANOL™ TPM.

Anionic

In some embodiments of the invention, the adhesive remover can include at least one anionic surfactant. In some embodiments the adhesive remover can include 1, 2, 3, or more anionic surfactants. In some embodiments, the anionic surfactant includes, but is not limited to a fatty acid. Fatty acids for use in the compositions of the invention include saturated fatty acids, unsaturated fatty acids, and mixtures thereof. Exemplary saturated fatty acids include, but are not limited to, caproic acid, caprylic acid, capric acid, lauric acid, myristic acid, palmitic acid, stearic acid, arachidic acid, and mixtures thereof Exemplary unsaturated fatty acids include, but are not limited to, palmitoleic acid, oleic acid, linoleic acid, linolenic acid, ricinoleic acid, and mixtures thereof. Additional fatty acids for use in the adhesive remover include, but are not limited to, saturated and/or unsaturated fatty acids obtained from natural sources such as plant or animal esters (e.g., palm kernel oil, palm oil, coconut oil, babassu oil, safflower oil, tall oil, castor oil, tallow and fish oils, grease, and mixtures thereof) or synthetically prepared (e.g., via the oxidation of petroleum or by hydrogenation of carbon monooxide via the Fisher-Tropsch process). In some embodiments, the anionic surfactant includes a coconut fatty acid.

Other exemplary anionic surfactants that can be included in the adhesive remover include carboxylates, isethionates, silicone containing surfactants, and mixtures thereof. In some embodiments, the anionic surfactant includes sulfonates, sulfates, and mixtures thereof. Suitable sulfates and sulfonates include, but are not limited to, alkyl aryl sulfonates, secondary alkane sulfonates, alkyl methyl ester sulfonates, alpha olefin sulfonates, alkyl ether sulfates, alkyl sulfates, alcohol sulfates, and mixtures thereof.

Exemplary alkyl aryl sulfonates that can be used can have an alkyl group that contains 6 to 24 carbon atoms and the aryl group can be at least one of benzene, toluene, and xylene. An exemplary alkyl aryl sulfonate includes linear alkyl benzene sulfonate. An exemplary linear alkyl benzene sulfonate includes linear dodecyl benzyl sulfonate that can be provided as an acid that is neutralized to form the sulfonate. Additional exemplary alkyl aryl sulfonates include xylene sulfonate and cumene sulfonate. Exemplary alkane sulfonates that can be used in the cleaning composition can have an alkane group having 6 to 24 carbon atoms. Exemplary alkane sulfonates that can be used include secondary alkane sulfonates. An exemplary secondary alkane sulfonate includes sodium $C_{14}$-$C_{17}$ secondary alkyl sulfonate commercially available as Hostapur SAS from Clariant. Exemplary alkyl methyl ester sulfonates that can be used in the cleaning composition include those having an alkyl group containing 6 to 24 carbon atoms. Exemplary alpha olefin sulfonates that can be used in the cleaning composition include those having alpha olefin groups containing 6 to 24 carbon atoms.

Exemplary alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. An exemplary alkoxy group is ethoxy. An exemplary alkyl ether sulfate is sodium lauric ether ethoxylate sulfate and is available under the name Steol® CS-460 (commercially available from Stepan Company). Exemplary alkyl sulfates that can be used in the cleaning composition include those having an alkyl group containing 6 to 24 carbon atoms. Exemplary alkyl sulfates include sodium lauryl sulfate and sodium lauryl/myristyl sulfate. Exemplary alcohol sulfates that can be used in the cleaning composition include those having an alcohol group containing about 6 to about 24 carbon atoms.

In some embodiments, the anionic surfactant includes an alkyl aryl sulfonate, an ether sulfate, a carboxylate, an isethionate, a silicone containing surfactant, a secondary alkane sulfonate, an alkyl methyl ester sulfonate, an alpha olefin sulfonate, an alkyl ether sulfate, an alkyl sulfate, an alcohol sulfate, and mixtures thereof. In some embodiments, the compositions include a fatty acid and an alkyl aryl sulfonic acid as anionic surfactants.

Amphoteric Surfactant

In some embodiments, the adhesive remover can include an amphoteric surfactant. Amphoteric surfactants that are anionic at an alkaline pH can be included in the adhesive remover. Exemplary amphoteric surfactants for use in the present invention include those derived from coconut products such as coconut oil or coconut fatty acid. In some embodiments, the coconut derived surfactants include as part of their structure an ethylenediamine moiety, an alkanolamide moiety, an amino acid moiety, preferably glycine, or a combination thereof; and an aliphatic substituent of from about 8 to 18 (preferably 12) carbon atoms. Such a surfactant can also be considered an alkyl amphodicarboxylic acid. Suitable amphoteric surfactants include, but are not limited to, disodium cocoampho dipropionate, which is commercially available under the tradename Miranol® FBS, and disodium cocoampho diacetate, which is commercially available under the tradename Miranol® C2M SF Conc. from Rhodia Inc., Cranbury N.J. In some embodiments, the amphoteric surfactant includes cocoamidopropyl hydroxysultaines, $C_8$ amphpocarboxylates, capril imidazoline dicarboxylates, sodium carboxyethyl cocophosphoethyl imadazoline, and octyl dipropionates. Commercially available examples of these materials are Amphoterge® KJ2 by Lonza, Crosultaine® C-50 by Croda, Rhodapon® JEM by Rhodia, Phosphoteric® TC-6 by Uniquema, and Deteric® ODP-LF by DeForest.

In some embodiments, the amphoteric surfactant includes a coconut derived surfactant. The coconut derived surfactant can include at least one of an ethylenediamine moiety, an alkanolamide moiety, an amino acid moiety, and combinations thereof; and an aliphatic substituent of from about 8 to 18 carbon atoms. In other embodiments, the coconut derived surfactant includes an amide mixture of coconut fatty acids. The amphoteric surfactant can include a cocoamine oxide surfactant, for example, Barlox® 12, a commercially available cocoamine oxide surfactant.

Cationic

In some embodiments, the adhesive remover compositions can include a cationic surfactant. Suitable additional surfactants include cationic surfactants. Exemplary cationic surfactants for use in the compositions of the invention include quaternary ammonium compounds such as alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

Exemplary alkylated quaternary ammonium compounds include ammonium compounds having an alkyl group containing between 6 and 24 carbon atoms. Exemplary alkylated quaternary ammonium compounds include monoalkyl trimethyl quaternary ammonium compounds, monomethyl trialkyl quaternary ammonium compounds, and dialkyl dimethyl quaternary ammonium compounds. Examples of the alkylated quaternary ammonium compounds are available commercially under the names Adogen™, Arosurf®, Variquat®, and Varisoft®. The alkyl group can be a $C_8$-$C_{22}$ group or a $C_8$-$C_{18}$ group or a $C_{12}$-$C_{22}$ group that is aliphatic and saturated or unsaturated or straight or branched, an alkyl group, a benzyl group, an alkyl ether propyl group, hydrogenated-tallow group, coco group, stearyl group, palmityl group, and soya group.

Exemplary ring or cyclic quaternary ammonium compounds include imidazolinium quaternary ammonium compounds and are available under the name Varisoft®. Exemplary imidazolinium quaternary ammonium compounds include methyl-1hydr. tallow amido ethyl-2-hydr. tallow imidazolinium-methyl sulfate, methyl-1-tallow amido ethyl-2-tallow imidazolinium-methyl sulfate, methyl-1-oleyl amido ethyl-2-oleyl imidazolinium-methyl sulfate, and 1-ethylene bis(2-tallow, 1-methyl, imidazolinium-methyl sulfate). Exemplary aromatic quaternary ammonium compounds include those compounds that have at least one benzene ring in the structure. Exemplary aromatic quaternary ammonium compounds include dimethyl alkyl benzyl quaternary ammonium compounds, monomethyl dialkyl benzyl quaternary ammonium compounds, trimethyl benzyl quaternary ammonium compounds, and trialkyl benzyl quaternary ammonium compounds. The alkyl group can contain between about 6 and about 24 carbon atoms, and can contain between about 10 and about 18 carbon atoms, and can be a stearyl group or a hydrogenated tallow group. Exemplary aromatic quaternary ammonium compounds are available under the names Variquat® and Varisoft®. The aromatic quaternary ammonium compounds can include multiple benzyl groups. Diquaternary ammonium compounds include those compounds that have at least two quaternary ammonium groups. An exemplary diquaternary ammonium compound is N-tallow pentamethyl propane diammonium dichloride and is available under the name Adogen 477.

Exemplary alkoxylated quaternary ammonium compounds include methyldialkoxy alkyl quaternary ammonium compounds, trialkoxy alkyl quaternary ammonium compounds, trialkoxy methyl quaternary ammonium compounds, dimethyl alkoxy alkyl quaternary ammonium compounds, and trimethyl alkoxy quaternary ammonium compounds. The alkyl group can contain between about 6 and about 24 carbon atoms and the alkoxy groups can contain between about 1 and about 50 alkoxy groups units wherein each alkoxy unit contains between about 2 and about 3 carbon atoms. Exemplary alkoxylated quaternary ammonium compounds are available under the names Variquat®, Varstat®, and Variquat®. Exemplary amidoamine quaternary ammonium compounds include diamidoamine quaternary ammonium compounds. Exemplary diamidoamine quaternary ammonium compounds are available under the name Varisoft®. Exemplary amidoamine quaternary ammonium compounds that can be used according to the invention are methyl-bis(tallow amidoethyl)-2-hydroxyethyl ammonium methyl sulfate, methyl bis (oleylamidoethyl)-2-hydroxyethyl ammonium methyl sulfate, and methyl bis (hydr.tallowamidoethyl)-2-hydroxyethyl ammonium methyl sulfate. Exemplary ester quaternary compounds are available under the name Stephantex™.

The quaternary ammonium compounds can include any counter ion that allows the component to be used in a manner that imparts fabric-softening properties. Exemplary counter ions include chloride, methyl sulfate, ethyl sulfate, and sulfate.

Water

Optionally, the compositions of this invention may include water. Water of any hardness may be included in the composition; however, preferably the water is less than 16 grain water hardness, more preferably less than 9 grain water hardness, and most preferably less than 4 grain water hardness. If water is included in the adhesive remover composition, it may be present between about 0 wt-% to about 20 wt-%. In a particular embodiments, the compositions may include from about 0 wt-% to about 15 wt-% water. In a further embodiment, the compositions include from about 2 wt-% to about 10 wt-% water.

Alkalinity Source

In particular embodiments, the adhesive remover composition can include an effective amount of one or more alkalinity sources to enhance cleaning and improve soil removal performance of the method. If the adhesive remover does not include an alkalinity source, it can be used in conjunction with the adhesive remover during cleaning, particularly in a reclaim process. In an embodiment, the compositions used in a laundry application may include an alkalinity source in an amount between about 60 ppm and about 4800 ppm. In an aspect of the invention the alkalinity source may be present in a regular wash between about 60 ppm and about 2880 ppm, more particularly between about 1000 ppm and about 2000 ppm, still more particularly between about 1200 ppm and about 1600 ppm. In another aspect of the invention the alkalinity source may be present in a reclaim process between about 1000 ppm and about 3600 ppm, more particularly between about 1800 ppm and about 3000 ppm.

An effective amount of one or more alkalinity sources should be considered as an amount that provides a use solution having a pH between about 9 and about 13.5 in a regular wash or reclaim process. In a particular embodiment the use solution of a regular wash will have a pH between about 10 and about 12.5. In a further embodiment, the use solution of a regular wash will have a pH between about 11 and about 12. In another embodiment the use solution of a reclaim process will have a pH between about 10 and about 13.5. In a further embodiment, the use solution of a reclaim process will have a pH between about 11 and about 13. In a still further embodiment, the use solution of a reclaim process will have a pH between about 12 and about 13.

Examples of suitable alkaline sources include, but are not limited to carbonate-based alkalinity sources, including, for example, an alkali metal carbonate; caustic-based alkalinity sources, including, for example, alkali metal hydroxides; other suitable alkalinity sources may include metal silicate, metal borate, and organic alkalinity sources. Exemplary alkali metal carbonates that can be used include, but are not limited to, sodium carbonate, potassium carbonate, bicarbonate, sesquicarbonate, and mixtures thereof. Exemplary alkali metal hydroxides that can be used include, but are not limited to sodium, lithium, or potassium hydroxide. Exemplary metal silicates that can be used include, but are not limited to, sodium or potassium silicate or metasilicate. Exemplary metal borates include, but are not limited to, sodium or potassium borate.

Organic alkalinity sources are often strong nitrogen bases including, for example, ammonia (ammonium hydroxide), amines, alkanolamines, and amino alcohols. Typical examples of amines include primary, secondary or tertiary amines and diamines carrying at least one nitrogen linked hydrocarbon group, which represents a saturated or unsaturated linear or branched alkyl group having at least 10 carbon atoms and preferably 16-24 carbon atoms, or an aryl, aralkyl, or alkaryl group containing up to 24 carbon atoms, and wherein the optional other nitrogen linked groups are formed by optionally substituted alkyl groups, aryl group or aralkyl groups or polyalkoxy groups. Typical examples of alkanolamines include monoethanolamine, monopropanolamine, diethanolamine, dipropanolamine, triethanolamine, tripropanolamine and the like. Typical examples of amino alcohols include 2-amino-2-methyl-1-propanol, 2-amino-1-butanol, 2-amino-2-methyl-1,3-propanediol, 2-amino-2-ethyl-1,3-propanediol, hydroxymethyl aminomethane, and the like.

In general, alkalinity sources are commonly available in either aqueous or powdered form, either of which is useful in formulating the compositions or use solutions contemplated by the present invention. The alkalinity may be added to the composition in any form known in the art, including as solid beads, granulated or particulate form, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45% and a 50% by weight solution.

Optional Functional Ingredients

The components of the adhesive remover compositions can further be combined with various functional components suitable for use in adhesive removal applications. In some embodiments, the adhesive remover composition including the solvent system, surfactant system, and optional water make up a large amount, or even substantially all of the total weight of the adhesive remover composition. For example, in some embodiments few or no optional functional ingredients are disposed therein. In particular embodiments of the invention, it is preferable to exclude dyes and odorants, particularly in adhesive remover compositions intended for healthcare textiles.

In other embodiments, optional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in the removal of adhesive, particularly from textiles in a laundry application. However, other embodiments may include functional ingredients for use in other applications.

Examples of optional functional ingredients that may be included in adhesive remover composition include alkalinity sources, anti-redeposition agents, bleaching agents, buffers, chelating and sequestering agents, detergent fillers, dispersants, dyes and odorants, enzymes, enzyme stabilizing system, rheology modifiers, rinse aids, thickeners, threshold agents, wetting and defoaming agents, and the like. Optional functional ingredients will vary according to the type of composition being manufactured and can be included in the compositions in any suitable amount.

Anti-Redeposition Agents

Adhesive remover compositions can include an anti-redeposition agent capable of facilitating sustained suspension of soils in a use solution and preventing the removed soils from being redeposited onto the article being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like.

Bleaching Agents

In some embodiments, the compositions of the present invention further include at least one bleaching agent. In some embodiments, the compositions of the present invention are substantially free of a bleaching agent. Bleaching agents for lightening or whitening a substrate, include bleaching compounds capable of liberating an active halogen species, such as $Cl_2$, $Br_2$, —$OCl^-$ and/or —$OBr^-$, under conditions typically encountered during the cleansing process can be included in use solutions. Suitable bleaching agents include, for example, chlorine-containing compounds such as a chlorine, a hypochlorite, chloramine. Halogen-releasing compounds may include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, each of these references is incorporated in its entirety).

A bleaching agent can also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like.

Builders

According to embodiments of the invention, the adhesive remover composition can also include a builder. Builders include chelating agents (chelators), sequestering agents (sequestrants), and the like. The builder may act to stabilize the cleaning composition or use solution. Examples of builders include, but are not limited to, phosphonates, phosphates, aminocarboxylates and their derivatives, pyrophosphates, polyphosphates, ethylenediamene and ethylenetriamene derivatives, hydroxyacids, and mono-, di-, and tricarboxylates and their corresponding acids. Other exemplary builders include aluminosilicates, nitroloacetates and their derivatives, and mixtures thereof. Still other exemplary builders include aminocarboxylates, including salts of ethylenediaminetetraacetic acid (EDTA), hydroxyethylenediaminetetraacetic acid (HEDTA), and diethylenetriaminepentaacetic acid. For a further discussion of chelating agents/sequestrants, see Kirk-Othmer, Encyclopedia of Chemical Technology, Third Edition, volume 5, pages 339-366 and volume 23, pages 319-320, which is incorporated herein in its entirety. According to an aspect of the invention, preferred builders are water soluble, biodegradable and phosphorus-free. The amount of builder in the cleaning composition or use solution, if present, is typically between about 10 ppm and about 1000 ppm in the cleaning composition or use solution.

Dyes/Odorants

Various dyes, odorants including perfumes, and other aesthetic enhancing agents can also be included in the adhesive remover compositions. Dyes can be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Solidification Agent

The present compositions can include a solidification agent, which can participate in maintaining the compositions in a solid form. In some embodiments, the solidification agent can form and/or maintain the composition as a solid. The solidification agent can include, for example, an organic or inorganic solid compound having a neutral inert character or making a functional, stabilizing or detersive contribution to the present composition. Suitable solidification agents include solid polyethylene glycol (PEG), solid polypropylene glycol, solid EO/PO block copolymer, amide, urea (also known as carbamide), nonionic surfactant (which can be employed with a coupler), anionic surfactant, starch that has been made water-soluble (e.g., through an acid or alkaline treatment process), cellulose that has been made water-soluble, inorganic agent, poly(maleic anhydride/methyl vinyl ether), polymethacrylic acid, other generally functional or inert materials with high melting points, mixtures thereof, and the like.

Suitable glycol solidification agents include a solid polyethylene glycol or a solid polypropylene glycol, which can, for example, have molecular weight of about 1,400 to about 30,000. In certain embodiments, the solidification agent includes or is solid PEG, for example PEG 1500 up to PEG 20,000. In certain embodiments, the PEG includes PEG 1450, PEG 3350, PEG 4500, PEG 8000, PEG 20,000, and the like. Suitable solid polyethylene glycols are commercially available from Union Carbide under the tradename CARBOWAX.

Suitable amide solidification agents include stearic monoethanolamide, lauric diethanolamide, stearic diethanolamide, stearic monoethanol amide, cocodiethylene amide, an alkylamide, mixtures thereof, and the like. In an embodiment, the present composition can include glycol (e.g., PEG) and amide.

Suitable nonionic surfactant solidification agents include nonylphenol ethoxylate, linear alkyl alcohol ethoxylate, ethylene oxide/propylene oxide block copolymer, mixtures thereof, or the like. Suitable ethylene oxide/propylene oxide block copolymers include those sold under the Pluronic tradename (e.g., Pluronic 108 and Pluronic F68) and commercially available from BASF Corporation. In some embodiments, the nonionic surfactant can be selected to be solid at room temperature or the temperature at which the composition will be stored or used. In other embodiments, the nonionic surfactant can be selected to have reduced aqueous solubility in combination with the coupling agent. Suitable couplers that can be employed with the nonionic surfactant solidification agent include propylene glycol, polyethylene glycol, mixtures thereof, or the like.

Suitable anionic surfactant solidification agents include linear alkyl benzene sulfonate, alcohol sulfate, alcohol ether sulfate, alpha olefin sulfonate, mixtures thereof, and the like. In an embodiment, the anionic surfactant solidification agent is or includes linear alkyl benzene sulfonate. In an embodiment, the anionic surfactant can be selected to be solid at room temperature or the temperature at which the composition will be stored or used.

Suitable inorganic solidification agents include phosphate salt (e.g., alkali metal phosphate), sulfate salt (e.g., magnesium sulfate, sodium sulfate or sodium bisulfate), acetate salt (e.g., anhydrous sodium acetate), Borates (e.g., sodium borate), Silicates (e.g., the precipitated or fumed forms (e.g., Sipernat 50® available from Degussa), carbonate salt (e.g., calcium carbonate or carbonate hydrate), other known hydratable compounds, mixtures thereof, and the like. In an embodiment, the inorganic solidification agent can include organic phosphonate compound and carbonate salt, such as an E-Form composition.

In some embodiments, the compositions of the present invention can include any agent or combination of agents that provide a requisite degree of solidification and aqueous solubility can be included in the present compositions. In other embodiments, increasing the concentration of the solidification agent in the present composition can tend to increase the hardness of the composition. In yet other embodiments, decreasing the concentration of solidification agent can tend to loosen or soften the concentrate composition.

In some embodiments, the solidification agent can include any organic or inorganic compound that imparts a solid character to and/or controls the soluble character of the present composition, for example, when placed in an aqueous environment. For example, a solidifying agent can provide controlled dispensing if it has greater aqueous solubility compared to other ingredients in the composition. Urea can be one such solidification agent. By way of further example, for systems that can benefit from less aqueous solubility or a slower rate of dissolution, an organic nonionic or amide hardening agent may be appropriate.

In some embodiments, the compositions of the present invention can include a solidification agent that provides for convenient processing or manufacture of the present composition. For example, the solidification agent can be selected to form a composition that can harden to a solid form under ambient temperatures of about 30 to about 50° C. after mixing ceases and the mixture is dispensed from the mixing system, within about 1 minute to about 3 hours, or about 2 minutes to about 2 hours, or about 5 minutes to about 1 hour.

The compositions of the present invention can include solidification agent at any effective amount. The amount of solidification agent included in the present composition can vary according to the type of composition, the ingredients of the composition, the intended use of the composition, the quantity of dispensing solution applied to the solid composition over time during use, the temperature of the dispensing solution, the hardness of the dispensing solution, the physical size of the solid composition, the concentration of the other ingredients, the concentration of the cleaning agent in the composition, and other like factors. Suitable amounts can include about 1 to about 99 wt-%, about 1.5 to about 85 wt-%, about 2 to about 80 wt-%, about 10 to about 45 wt-%, about 15% to about 40 wt-%, about 20% to about 30 wt-%, about 30% to about 70%, about 40% to about 60%, up to about 50 wt-%, about 40% to about 50%.

Thickening/Gelling Agents

The compositions of the present invention can include any of a variety of known thickeners. Suitable thickeners include natural gums such as xanthan gum, guar gum, or other gums from plant mucilage; polysaccharide based thickeners, such as alginates, starches, and cellulosic polymers (e.g., carboxymethyl cellulose); polyacrylates thickeners; and hydrocolloid thickeners, such as pectin. In an embodiment, the thickener does not leave contaminating residue on the surface of an object. For example, the thickeners or gelling agents can be compatible with food or other sensitive products in contact areas. Generally, the concentration of thickener employed in the present compositions or methods will be dictated by the desired viscosity within the final composition. However, as a general guideline, the viscosity of thickener within the present composition ranges from about 0.1 wt-% to about 5 wt-%, from about 0.1 wt-% to about 1.0 wt-%, or from about 0.1 wt-% to about 0.5 wt-%.

Wetting/Defoaming Agents

Also potentially useful in the compositions of the invention are wetting and defoaming agents. Wetting agents function to increase the surface contact or penetration activity of the antimicrobial composition of the invention. Wetting agents which can be used in the composition of the invention include any of those constituents known within the art to raise the surface activity of the composition of the invention.

Generally, defoamers which can be used in accordance with the invention include silica and silicones, particularly silica dispersed in polydimethylsiloxane; fatty esters; fatty alcohols; sulfates or sulfonates; amines or amides; halogenated compounds such as fluorochlorohydrocarbons; vegetable oils; polyethylene glycol esters; hydrocarbon waxes; ethoxylates; mineral oils as well as their sulfonated or sulfated derivatives; fatty acids and/or their soaps such as alkali, alkaline earth metal soaps; and phosphates and phosphate esters such as alkyl and alkaline diphosphates, and tributyl phosphates among others; and mixtures thereof. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al. Each of these references is incorporated herein it its entirety.

In some embodiments, the compositions of the present invention can include antifoaming agents or defoamers which are of food grade quality given the application of the method of the invention. To this end, one of the more effective antifoaming agents includes silicones. Silicones such as dimethyl silicone, glycol polysiloxane, methylphenol polysiloxane, trialkyl or tetralkyl silanes, hydrophobic silica defoamers and mixtures thereof can all be used in defoaming applications. Commercial defoamers commonly available include silicones such as Ardefoam® from Armour Industrial Chemical Company which is a silicone bound in an organic emulsion; Foam Kill® or Kresseo® available from Krusable Chemical Company which are silicone and non-silicone type defoamers as well as silicone esters; and Anti-Foam A® and DC-200 from Dow Corning Corporation which are both food grade type silicones among others.

Exemplary Embodiments

Exemplary ranges of the adhesive remover compositions according to an embodiment of the invention are shown in Table 1 in weight percentage of the adhesive remover composition.

The compositions of the present invention can be prepared in many diverse forms. For example, according to the invention the adhesive remover compositions can be in liquid or solid form. If prepared in liquid form, the compositions may be a concentrate or may be diluted. If prepared in solid form, the compositions may be molded or formed in pellet, block, tablet, powder, granule, flake form. Those of skill in the art will be able to select a desired form and prepare the compositions in that form.

TABLE 1

Exemplary Compositional Weight Ranges (wt-%)

| Ingredient | First Range | Second Range | Third Range |
|---|---|---|---|
| Water | 0-20 | 0-15 | 2-10 |
| Aliphatic glycol ether | 5-35 | 10-30 | 15-25 |
| Aromatic glycol ether | 1-20 | 5-15 | 7-12 |
| Hydrophobic glycol ether | 1-20 | 5-15 | 7-12 |
| Hydrophilic glycol ether | 1-20 | 5-15 | 7-12 |
| First nonionic surfactant | 2-30 | 5-25 | 10-20 |
| Second nonionic surfactant | 2-30 | 5-25 | 10-20 |
| Third nonionic surfactant | 2-30 | 5-25 | 10-20 |

In certain embodiments, the solid composition can be provided in the form of a unit dose. A unit dose refers to a solid detergent composition unit sized so that the entire unit is used during a single washing cycle. When the solid detergent composition is provided as a unit dose, it is typically provided as a cast solid, an extruded pellet, or a tablet. In other embodiments, the solid detergent composition is provided in the form of a multiple-use solid, such as a block or a plurality of pellets, and can be repeatedly used to generate aqueous detergent compositions for multiple washing cycles. In certain embodiments, the solid composition can be provided as a cast solid, an extruded block, or a tablet having a mass. In certain embodiments, the solid composition may be prepared in a multiple-use form of the solid detergent composition has a mass between approximately 1 kilogram and approximately 10 kilograms.

The adhesive remover compositions may include concentrate compositions or may be diluted. In general, a concentrate refers to a composition that is intended to be diluted with water to provide a use solution that contacts a textile to provide the desired cleaning, rinsing, or the like. The adhesive remover composition that contacts the textiles to be washed can be referred to as a concentrate or a use composition (or use solution) dependent upon the formulation employed in methods according to the invention. It should be understood that the concentration of the solvent system, surfactant system, water and other optional ingredients in the detergent composition will vary depending on whether the detergent composition is provided as a concentrate or dilution.

Methods of Use

The adhesive remover compositions of the present invention can be prepared and used in many diverse applications. For example, the compositions may be used before a laundry application, after a laundry application, during a regular wash, during a reclaim process, in conjunction with a detergent, or in conjunction with an alkalinity source. In particular embodiments, the compositions may be applied independently as a liquid spray, as a poured liquid, or as a solid. In another aspect, the compositions can be used independently in a wash cycle. In another embodiment, the compositions can be used with a detergent formula. For example, the adhesive remover compositions can be incorporated in a liquid or solid detergent or may be added to a laundry application with a detergent. One of skill in the art will be able to ascertain the various methods of use for the medical adhesive compositions and discern which method is preferred for the desired result or application.

While an understanding of the mechanism is not necessary to practice the present invention and while the present invention is not limited to any particular mechanism of action, it is contemplated that, in some embodiments, the adhesive remover compositions can be used in a regular wash and in other embodiments, the adhesive remover compositions can be used in a reclaim process. The following are exemplary embodiments of the present invention and it should be understood that the embodiments are not exclusive and may be varied in many ways. For example, the adhesive remover compositions may be formulated and applied to healthcare surfaces, medical instruments, and the like to remove medical adhesive soils. Such variations are not to be regarded as a departure from the spirit and scope of the inventions and all such modifications are intended to be included within the scope of the following claims.

Regular Wash

According to an embodiment of the invention the adhesive remover compositions of the present invention may be used in a regular wash. In an aspect of the invention, the adhesive remover compositions can be used in a regular wash performed at a temperature between about 100° F. and about 200° F. In another embodiment of the invention, the compositions may be used in a regular wash performed at a temperature between about 110° F. and about 190° F. In a further embodiment of the invention, the compositions may be used in a regular wash performed at a temperature between about 120° F. and about 180° F. In a still further embodiment of the invention, the compositions may be used in a regular wash performed at a temperature between about 130° F. and about 170° F. In yet a further embodiment of the invention, the compositions may be used in a regular wash performed at a temperature between about 145° F. and about 165° F.

In another aspect of the invention, the adhesive remover compositions can be used in a regular wash in an amount between about 2-20 ounces per 100 pounds of laundry, preferably between about 2-15 ounces per 100 pounds of laundry, more preferably between about 2-10 ounces per 100 pounds of laundry.

In another aspect of the invention, the adhesive remover compositions can be used in a regular wash with between about 60 ppm and about 2880 ppm of an alkalinity source, preferably between about 1000 ppm and about 2000 ppm of an alkalinity source, more preferably between about 1200 ppm and about 1600 ppm of an alkalinity source. In further aspect of the invention, the adhesive remover compositions can be used in a regular wash with a pH between about 9 and about 12.5; preferably between about 10 and about 12.5; more preferably between about 11 and about 12.

Reclaim Process

According to an embodiment of the invention the adhesive remover compositions of the present invention may be used in a reclaim process. In an aspect of the invention, the adhesive remover compositions can be used in a reclaim process performed at a temperature between about 100° F. and about 210° F. In a another embodiment of the invention, the compositions may be used in a reclaim process performed at a temperature between about 130° F. and about 200° F. In a further embodiment of the invention, the compositions may be used in a reclaim process performed at a temperature between about 160° F. and about 190° F. In yet a further embodiment of the invention, the compositions may be used in a reclaim process performed at temperatures between about 175° F. and about 180° F.

In another aspect of the invention, the adhesive remover compositions can be used in a reclaim process in an amount between about 2-30 ounces per 100 pounds of laundry, preferably between about 5-25 ounces per 100 pounds of laundry, more preferably between about 10-20 ounces per 100 pounds of laundry.

In another aspect of the invention, the adhesive remover compositions can be used in a reclaim process with between about 60 ppm and about 4800 ppm of an alkalinity source, preferably between about 1000 ppm and about 3600 ppm of an alkalinity source, more preferably between about 1800 ppm and about 3000 ppm of an alkalinity source. In further aspect of the invention, the adhesive remover compositions can be used in a reclaim process with a pH between about 10 and about 13.5; preferably between about 11 and about 13; more preferably between about 12 and about 13.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

An exemplary adhesive remover composition was prepared as provided in Table 2.

TABLE 2

Exemplary Adhesive Remover Composition

| Ingredient | Concentration (wt. %) |
|---|---|
| Water | 5 |
| Hexyl Carbitol ™ Solvent | 19 |
| DOWANOL ™ EPh | 9.5 |
| DOWANOL ™ TPnB | 9.5 |
| DOWANOL ™ TPM | 9.5 |
| ECOSURF ™ EH-6 Surfactant | 15.2 |
| ECOSURF ™ EH-9 Surfactant | 16.15 |
| TERGITOL ™ 15-S-15 Surfactant | 16.15 |

The materials used in the following Examples are provided herein:

Hexyl Carbitol™ Solvent: an aliphatic glycol ether available from the Dow Chemical Company.

DOWANOL™ EPh Glycol Ether: an aromatic glycol ether available from the Dow Chemical Company.

DOWANOL™ TPnB: a hydrophobic glycol ether available from the Dow Chemical Company.

DOWANOL™ TPM: a hydrophilic glycol ether available from the Dow Chemical Company.

ECOSURF™ EH-6 Surfactant: a nonionic alcohol ethoxylate surfactant available from the Dow Chemical Company.

ECOSURF™ EH-9 Surfactant: a nonionic alcohol ethoxylate surfactant available from the Dow Chemical Company.

TERGITOL™ 15-S-15 Surfactant: a nonionic secondary alcohol ethoxylate surfactant available from the Dow Chemical Company.

Additional materials commercially-available from multiple sources include: water.

Example 1

Three colors of napkins were selected, black, red, and white. Each napkin was cut into four equal size pieces and soiled with three drops of corn oil, vegetable oil, and canola oil. The soiled napkins were cleaned in a regular wash at temperatures between about 100° F. and about 200° F., with the exemplary adhesive remover composition of Table 2, a traditional limonene-based detergent, and a traditional petroleum distillate-based detergent. The wash cycle information is provided in Tables 3-5. Upon completion of the wash cycles, the napkins were visually inspected to determine if oil residue was still visible. The results of the visual inspection are provided in Table 6 below. From reviewing Table 6 below it is apparent that the exemplary formula provided in Table 2 performed equally as well as traditional limonene-based and petroleum distillate-based detergents in removing common oil stains from fabric.

TABLE 3

Wash Cycle with Exemplary Detergent of Table 2

| Step Number | Step Type | Time | Temp | Level | Product | Dose (oz/cwt) |
|---|---|---|---|---|---|---|
| 1 | Flush | 4:00 | 120 | 12 | Alkaline Builder | 2.25 |
| 2 | Break | 15:00 | 160 | 12 | Alkaline Builder | 16.9 |
| | | | | | Remedy | 2.25 |
| | | | | | Detergent | 8 |
| 3 | Rinse | 2:00 | Hot | 9 | | |
| 4 | Rinse | 2:00 | Hot | 12 | | |
| 5 | Rinse | 2:00 | Split | 12 | | |
| 6 | Sour | 4:00 | 100 | 9 | | |
| 7 | Extract | 6:00 | 0 | 0 | | |

TABLE 4

Wash Cycle with Limonene-Based Detergent

| Step Number | Step Type | Time | Temp | Level | Product | Dose (oz/cwt) |
|---|---|---|---|---|---|---|
| 1 | Flush | 4:00 | 120 | 12 | Alkaline Builder | 2.25 |
| 2 | Break | 15:00 | 160 | 12 | Alkaline Builder | 16.9 |
| | | | | | Remedy | 2.25 |
| | | | | | Detergent | 55 |

TABLE 4-continued

| Wash Cycle with Limonene-Based Detergent | | | | | | |
|---|---|---|---|---|---|---|
| Step Number | Step Type | Time | Temp | Level | Product | Dose (oz/cwt) |
| 3 | Rinse | 2:00 | Hot | 9 | | |
| 4 | Rinse | 2:00 | Hot | 12 | | |
| 5 | Rinse | 2:00 | Split | 12 | | |
| 6 | Sour | 4:00 | 100 | 9 | | |
| 7 | Extract | 6:00 | 0 | 0 | | |

TABLE 5

| Wash Cycle with Petroleum Distillate-Based Detergent | | | | | | |
|---|---|---|---|---|---|---|
| Step Number | Step Type | Time | Temp | Level | Product | Dose (oz/cwt) |
| 1 | Scrub | 6:00 | 160 | 4 | Detergent | 40 |
| 2 | Break | 34:00 | 160 | 9 | | |
| 3 | Rinse | 2:00 | 145 | 18 | | |
| 4 | Rinse | 2:00 | 130 | 18 | | |
| 5 | Rinse | 2:00 | 115 | 18 | | |
| 6 | Rinse | 2:00 | 100 | 18 | | |
| 7 | Rinse | 2:00 | Cold | 18 | | |
| 8 | Sour | 5:00 | Cold | 18 | | |
| 9 | Extract | 6:00 | 0 | 0 | | |

TABLE 6

| Detergent Comparison Results | | | |
|---|---|---|---|
| | Napkin | | |
| Detergent | Black | White | Red |
| Exemplary Detergent of Table 2 | No Oil Residue | No Oil Residue | All Three Oils Appeared |
| | No Oil Residue | No Oil Residue | All Three Oils Appeared |
| | No Oil Residue | No Oil Residue | All Three Oils Appeared |
| Limonene-Based Detergent | No Oil Residue | No Oil Residue | All Three Oils Appeared |
| | No Oil Residue | No Oil Residue | All Three Oils Appeared |
| | No Oil Residue | No Oil Residue | All Three Oils Appeared |
| Petroleum Distillate-Based Detergent | No Oil Residue | No Oil Residue | All Three Oils Appeared |
| | No Oil Residue | No Oil Residue | All Three Oils Appeared |
| | No Oil Residue | No Oil Residue | All Three Oils Appeared |

Example 2

Healthcare textiles were soiled with medical adhesives listed in Table 7. The soiled healthcare textiles were read on a HunterLab Colorquest XE Spectrophotometer. The soiled healthcare textiles were cleaned in a regular wash at temperatures between about 100° F. and about 200° F., with the exemplary adhesive remover composition of Table 2. The wash cycle information is provided in Table 3.

If soils were remaining after the regular wash, the textiles were put through a reclaim process, at temperatures between about 100° F. and about 210° F. During the reclaim process, the exemplary adhesive remover of Table 2 was used at 16 ounces per 100 pounds of laundry. Some of the medical adhesives were applied to two sets of healthcare textiles (as seen in Table 7) and the second set of soiled healthcare textiles was washed with a traditional limonene-based detergent as provided in Table 4.

These were intended for comparison with the medical adhesive composition of Table 2. The washed and/or reclaimed healthcare textiles were read on the spectrophotometer and the percent soil removal was calculated per the following formula:

$$\text{Percent Soil Removal}=(L^*_{final}-L^*_{initial})/(96-L^*_{initial})$$

The spectrophotometer provided a "L*" value between "0" and "100," where "0" equaled totally black and "100" equaled totally white. A reading of "96" equaled the ideal clean number. For each of the healthcare textiles the percent soil removal was calculated. A percent soil removal of greater than 90% was ideal and a percent soil removal greater than 85% was considered satisfactory. The results of the testing are set forth in Table 7.

As is demonstrated by Table 7, the exemplary medical adhesive composition of Table 2 provided better removal of the medical adhesives than the traditional limonene-based detergent for every medical adhesive compared. And in all but two of those compared, the difference in percent of soil removal was at least twenty percent—demonstrating substantially better medical adhesive removal by the composition of Table 2. Moreover, the exemplary medical adhesive remover composition of Table 2 provided percent soil removal of greater than 85% on all but one medical adhesive, and greater than 90% on six of the medical adhesives tested. Furthermore, the exemplary medical adhesive remover of Table 2 was used at only 8 ounces per 100 pounds of laundry in the regular wash and only 16 ounces per 100 pounds of laundry in the reclaim process. Both laundry applications utilized less adhesive remover than is traditionally required by existing methods—typically requiring between about 20-50 ounces per 100 pounds.

TABLE 7

| Adhesive Remover Composition Efficacy Test | | |
|---|---|---|
| | Percent Soil Removal | |
| Medical Adhesive | Exemplary Formula | Traditional Detergent |
| Autoclave Tape Thick | ≥90% | ≥85% |
| Autoclave Tape Thin | ≥85% | ≥75% |
| Med/PE 175 W + Euro Tape | ≥85% | <65% |
| Med/TS 175 Euro Tape | ≥85% | <65% |
| Med/PE 175 H + Euro Tape | ≥85% | <65% |
| VP 6141 Euro Tape | ≥85% | <65% |
| Lohmann Euro Tape | ≥85% | <65% |
| Band-Aid Fabric Bandages | ≥90% | |
| Up&Up Plastic Bandages | ≥90% | |
| 3M Nexcare Waterproof Bandages | <65% | |
| Johnson & Johnson Cloth Tape | ≥90% | |
| Johnson & Johnson Waterproof Tape | ≥90% | |
| 3M Transpore Tape | ≥90% | |

The inventions being thus described, it will be obvious that the same may be varied in many ways. Such variations are not to be regarded as a departure from the spirit and scope of the inventions and all such modifications are intended to be included within the scope of the following claims.

The above specification provides a description of the manufacture and use of the disclosed compositions and methods. Since many embodiments can be made without departing from the spirit and scope of the invention, the invention resides in the claims.

What is claimed is:

1. An adhesive remover composition comprising:

from about 25 wt-% to about 75 wt-% of a glycol ether solvent system comprising:

(a) a first solvent comprising diethylene monohexyl ether present between about 15 wt. % and about 25 wt. % of the composition;

(b) a second solvent comprising ethylene glycol phenyl ether present between about 7 wt. % and about 12 wt. % of the composition;

(c) a third solvent comprising tripropylene glycol n-butyl ether present between about 7 wt. % and about 12 wt. % of the composition;

(d) a fourth solvent comprising tripropylene glycol methyl ether present between about 7 wt. % and about 12 wt. % of the composition; and from about 30 wt-% to about 75 wt-% of a surfactant system containing at least one nonionic surfactant comprising an alcohol alkoxylate;

wherein the composition is capable of being diluted with water to form a use solution; and wherein the composition is present in the use solution in a concentration of between about 2 oz/cwt to about 16 oz/cwt.

2. The composition of claim 1, wherein the surfactant system contains at least two nonionic surfactants.

3. The composition of claim 2, wherein the at least two nonionic surfactants comprise the alcohol alkoxylate and an additional alcohol alkoxylate.

4. The composition of claim 1, wherein the glycol ether solvent system is between about 36 wt. % and about 75 wt. % of the composition.

5. The composition of claim 1, wherein the surfactant system is from about 30 wt-% to about 60 wt-% of the composition.

6. The composition of claim 1, wherein the composition is phosphorus-free.

7. The composition of claim 1, wherein the composition is free of petroleum distillates.

8. The composition of claim 1, wherein the composition is free of nonylphenol ethoxylates.

9. The composition of claim 1, wherein the composition is free of D-limonene.

10. The composition of claim 5, wherein the surfactant system is between about 40 wt. % and about 55 wt. % of the composition.

11. A method of removing adhesives from textiles comprising:

contacting a textile soiled by an adhesive with the adhesive remover of claim 1;

cleaning the textile in a laundry application at a temperature between about 100° F. and about 200° F.

12. The method of claim 11, wherein the contacting step occurs before the laundry application, after the laundry application, during a regular wash, or during a reclaim process.

13. The method of claim 11, wherein the contacting step further comprises combining water.

14. The method of claim 11, wherein the contacting step further comprises combining an alkalinity source to achieve a concentration of between about 60 ppm and about 4800 ppm in a use solution.

15. The method of claim 11, wherein the contacting step is a regular wash or reclaim a process.

16. The method of claim 11, wherein the contacting step further comprises contacting the textile with about 8 oz/cwt of adhesive remover.

17. The method of claim 11, wherein contacting step further comprises a laundry detergent.

18. The method of claim 11, wherein the adhesive is a medical adhesive and the textile is a healthcare textile.

* * * * *